US008366485B2

(12) United States Patent
Johnescu et al.

(10) Patent No.: US 8,366,485 B2
(45) Date of Patent: Feb. 5, 2013

(54) ELECTRICAL CONNECTOR HAVING RIBBED GROUND PLATE

(75) Inventors: Douglas M. Johnescu, York, PA (US); Jonathan E. Buck, Hershey, PA (US)

(73) Assignee: FCI Americas Technology LLC, Carson City, NV (US)

( * ) Notice: Subject to any disclaimer, the term of this patent is extended or adjusted under 35 U.S.C. 154(b) by 257 days.

(21) Appl. No.: 12/722,797

(22) Filed: Mar. 12, 2010

(65) Prior Publication Data

US 2010/0240233 A1 Sep. 23, 2010

Related U.S. Application Data

(60) Provisional application No. 61/161,687, filed on Mar. 19, 2009.

(51) Int. Cl.
*H01R 13/648* (2006.01)

(52) U.S. Cl. ..... 439/607.07; 439/607.09; 439/108

(58) Field of Classification Search ..... 439/607.06, 439/607.07, 607.09, 108
See application file for complete search history.

(56) References Cited

U.S. PATENT DOCUMENTS

| | | | |
|---|---|---|---|
| 4,464,003 | A | 8/1984 | Goodman et al. |
| 4,596,428 | A | 6/1986 | Tengler |
| 4,632,476 | A | 12/1986 | Schell |
| 4,655,515 | A | 4/1987 | Hamsher, Jr. et al. |
| 4,705,332 | A | 11/1987 | Sadigh-Behzadi |
| 4,806,107 | A | 2/1989 | Arnold et al. |
| 4,820,169 | A | 4/1989 | Weber et al. |
| 4,824,383 | A | 4/1989 | Lemke |
| 4,836,791 | A | 6/1989 | Grabbe et al. |
| 4,846,727 | A | 7/1989 | Glover et al. |
| 4,854,899 | A | 8/1989 | Matthews |
| 4,882,554 | A | 11/1989 | Akaba et al. |
| 4,952,172 | A | 8/1990 | Barkus et al. |

(Continued)

FOREIGN PATENT DOCUMENTS

| | | |
|---|---|---|
| DE | 3529218 | 2/1986 |
| DE | 3605316 | 8/1987 |

(Continued)

OTHER PUBLICATIONS

Derman "Speed, Density Push Design Xomplexities," Electronic Engineering Times, May 1998, 2 pages.

(Continued)

*Primary Examiner* — Hien Vu
(74) *Attorney, Agent, or Firm* — Woodcock Washburn LLP

(57) ABSTRACT

An electrical connector includes a dielectric housing, a plurality of electrical signal contacts carried by the dielectric housing, and a ground plate carried by the dielectric housing. The electrical signal contacts are arranged along a first plane, wherein the signal contacts define signal pairs such that a respective gap is disposed between adjacent signal pairs. The signal contacts further define respective mating and mounting ends. The ground plate includes a ground plate body oriented in a second plane that is substantially parallel to the first plane and offset from the first plane. The ground plate body defines first and second opposed surfaces. The ground plate includes at least one rib that defines first and second opposed surfaces, wherein the first surface of the rib projects from the first surface of the ground plate body in a direction toward the gap, and the second surface is recessed into the second surface of the ground plate body. The ground plate further includes a plurality of mating ends and mounting ends extending from the ground plate body and disposed in the first plane so as to be aligned with the respective mating ends and mounting ends of the electrical signal contacts.

15 Claims, 11 Drawing Sheets

U.S. PATENT DOCUMENTS

| | | | | |
|---|---|---|---|---|
| 4,975,069 | A | 12/1990 | Fedder et al. | |
| 4,975,084 | A | 12/1990 | Fedder et al. | |
| 5,046,960 | A | 9/1991 | Fedder | |
| 5,066,236 | A | 11/1991 | Broeksteeg | |
| 5,083,238 | A | 1/1992 | Bousman | |
| 5,104,341 | A | 4/1992 | Gilissen et al. | |
| 5,117,331 | A | 5/1992 | Gebara | |
| 5,224,867 | A | 7/1993 | Ohtsuki et al. | |
| 5,228,864 | A | 7/1993 | Fusselman et al. | |
| 5,286,212 | A | 2/1994 | Broeksteeg | |
| 5,342,211 | A | 8/1994 | Broeksteeg | |
| 5,354,219 | A | 10/1994 | Wanjura | |
| 5,403,206 | A | 4/1995 | McNamara et al. | |
| 5,429,520 | A | 7/1995 | Morlion et al. | |
| 5,433,617 | A | 7/1995 | Morlion et al. | |
| 5,433,618 | A | 7/1995 | Morlion et al. | |
| 5,496,183 | A | 3/1996 | Soes et al. | |
| 5,580,283 | A | 12/1996 | O'Sullivan et al. | |
| 5,664,968 | A | 9/1997 | Mickievicz | |
| 5,718,606 | A | 2/1998 | Rigby et al. | |
| 5,743,765 | A | 4/1998 | Andrews et al. | |
| 5,795,191 | A | 8/1998 | Preputnick et al. | |
| 5,851,121 | A | 12/1998 | Thenaisie et al. | |
| 5,913,702 | A | 6/1999 | Garcin | |
| 5,938,479 | A | 8/1999 | Paulson et al. | |
| 5,943,770 | A | 8/1999 | Thenaisie et al. | |
| 6,027,381 | A | 2/2000 | Lok | |
| 6,042,394 | A | 3/2000 | Mitra et al. | |
| 6,050,842 | A | 4/2000 | Ferrill et al. | |
| 6,083,047 | A | 7/2000 | Paagman | |
| 6,113,418 | A | 9/2000 | Kjeldahl | |
| 6,206,735 | B1 | 3/2001 | Zanoli | |
| 6,244,887 | B1 | 6/2001 | Commerci et al. | |
| 6,290,552 | B1 | 9/2001 | Saito et al. | |
| 6,347,962 | B1 | 2/2002 | Kline | |
| 6,361,366 | B1 | 3/2002 | Shuey et al. | |
| 6,361,376 | B1 | 3/2002 | Onoda | |
| 6,364,710 | B1 | 4/2002 | Billman et al. | |
| 6,371,813 | B2 | 4/2002 | Ramey et al. | |
| 6,375,508 | B1 | 4/2002 | Pickles et al. | |
| 6,379,188 | B1 | 4/2002 | Cohen et al. | |
| 6,431,921 | B2 | 8/2002 | Saito et al. | |
| 6,491,545 | B1 | 12/2002 | Spiegel et al. | |
| 6,503,103 | B1 | 1/2003 | Cohen et al. | |
| 6,517,360 | B1 | 2/2003 | Cohen | |
| 6,527,588 | B2 | 3/2003 | Paagman | |
| 6,544,072 | B2 | 4/2003 | Olson | |
| 6,551,140 | B2 | 4/2003 | Billman et al. | |
| 6,592,381 | B2 | 7/2003 | Cohen et al. | |
| 6,602,095 | B2 | 8/2003 | Astbury, Jr. et al. | |
| 6,607,402 | B2 | 8/2003 | Cohen et al. | |
| 6,623,310 | B1 | 9/2003 | Billman et al. | |
| 6,652,318 | B1 | 11/2003 | Winings et al. | |
| 6,666,693 | B2 | 12/2003 | Belopolsky et al. | |
| 6,692,272 | B2 | 2/2004 | Lemke et al. | |
| 6,702,590 | B2 | 3/2004 | Zaderej et al. | |
| 6,709,294 | B1 | 3/2004 | Cohen et al. | |
| 6,712,646 | B2 | 3/2004 | Shindo | |
| 6,739,910 | B1 | 5/2004 | Wu | |
| 6,746,278 | B2 * | 6/2004 | Nelson et al. | 439/607.07 |
| 6,814,619 | B1 * | 11/2004 | Stokoe et al. | 439/607.07 |
| 6,872,085 | B1 * | 3/2005 | Cohen et al. | 439/108 |
| 6,899,566 | B2 | 5/2005 | Kline et al. | |
| 6,913,490 | B2 | 7/2005 | Whiteman et al. | |
| 6,918,789 | B2 | 7/2005 | Lang et al. | |
| 6,979,202 | B2 | 12/2005 | Benham et al. | |
| 7,040,901 | B2 | 5/2006 | Benham et al. | |
| 7,163,421 | B1 | 1/2007 | Cohen et al. | |
| 7,281,950 | B2 | 10/2007 | Belopolsky | |
| 7,316,585 | B2 | 1/2008 | Smith et al. | |
| 7,347,740 | B2 | 3/2008 | Minich | |
| 7,384,311 | B2 | 6/2008 | Sharf et al. | |
| 7,422,483 | B2 | 9/2008 | Avery et al. | |
| 7,467,955 | B2 | 12/2008 | Raistrick et al. | |
| 7,497,735 | B2 | 3/2009 | Belopolsky | |
| 7,497,736 | B2 | 3/2009 | Minich et al. | |
| 7,500,871 | B2 | 3/2009 | Minich et al. | |
| 7,503,804 | B2 | 3/2009 | Minich | |
| 7,553,182 | B2 | 6/2009 | Buck et al. | |
| 7,588,463 | B2 * | 9/2009 | Yamada et al. | 439/607.05 |
| 7,762,843 | B2 | 7/2010 | Minich et al. | |
| 2001/0041477 | A1 | 11/2001 | Billman et al. | |
| 2001/0046810 | A1 | 11/2001 | Cohen et al. | |
| 2001/0046816 | A1 | 11/2001 | Saito et al. | |
| 2002/0013101 | A1 | 1/2002 | Long | |
| 2002/0106932 | A1 | 8/2002 | Holland et al. | |
| 2002/0142629 | A1 | 10/2002 | Zaderej et al. | |
| 2002/0173177 | A1 | 11/2002 | Korsunsky | |
| 2003/0143894 | A1 | 7/2003 | Kline et al. | |
| 2004/0018757 | A1 | 1/2004 | Lang et al. | |
| 2004/0038590 | A1 | 2/2004 | Lang et al. | |
| 2004/0072470 | A1 | 4/2004 | Lang et al. | |
| 2004/0087196 | A1 | 5/2004 | Lang et al. | |
| 2005/0026503 | A1 | 2/2005 | Trout et al. | |
| 2006/0228912 | A1 | 10/2006 | Morlion et al. | |
| 2007/0021002 | A1 | 1/2007 | Laurx et al. | |
| 2007/0099512 | A1 | 5/2007 | Sato | |
| 2008/0246555 | A1 | 10/2008 | Kirk et al. | |
| 2008/0316729 | A1 | 12/2008 | Rothermel et al. | |
| 2009/0011643 | A1 | 1/2009 | Amleshi et al. | |
| 2010/0240233 | A1 | 9/2010 | Johnescu et al. | |

FOREIGN PATENT DOCUMENTS

| | | |
|---|---|---|
| DE | 4040551 | 4/1993 |
| EP | 0212764 | 3/1987 |
| EP | 337634 | 10/1989 |
| EP | 0442785 | 8/1991 |
| EP | 0486298 A1 | 5/1992 |
| EP | 0560550 | 9/1993 |
| EP | 0562691 | 9/1993 |
| EP | 0486298 B1 | 1/1996 |
| EP | 1111730 | 6/2001 |
| JP | 2007-128706 | 5/2007 |
| WO | WO 96/38889 | 12/1996 |
| WO | WO 02/058191 | 7/2002 |
| WO | WO 02/101882 | 12/2002 |

OTHER PUBLICATIONS

IBM Bulletin, Shielded In-Line Electrical Multiconnector, Aug. 1967, 10(3), 3 pages.

International Application No. PCT/US2003/014370, International Search Report dated Aug. 6, 2003, 2 pages.

International Application No. PCT/US2010/040899, International Search Report dated Jan. 25, 2011, 9 pages.

Siemens, "SpeedPac: A New Concept for the Next Generation of Transmission Speed," Backplane Interconnection, Issue 1/96.

* cited by examiner

ELECTRICAL CONNECTOR HAVING RIBBED GROUND PLATE

CROSS-REFERENCE TO RELATED APPLICATIONS

This claims priority to U.S. Patent Application Ser. No. 61/161,687 filed Mar. 19, 2009, the disclosure of which is hereby incorporated by reference as if set forth in its entirety herein.

BACKGROUND

Electrical connectors provide signal connections between electronic devices using electrically-conductive contacts. It is sometimes desirable to increase data transfer through an existing connector without changing the physical dimensions (height, width, depth, mating interface, and mounting interface) of the connector. However, it is difficult to change one aspect of an electrical connector without unintentionally changing another aspect. For example, metallic crosstalk shields can be added to an electrical connector to reduce crosstalk, but the addition of shields generally lowers the impedance. At lower data transmission speeds, such at 1 to 1.25 Gigabits/sec, impedance matching does not substantially affect performance. However, as data transmission speeds increase to 10 Gigabits/sec through 40 Gigabits/sec and any discrete point therebetween, skew and impedance mismatches become problematic. Therefore, while crosstalk can be lowered by adding a metallic crosstalk shield to an existing electrical connector, other problems with signal integrity can be created.

What is therefore desired is an electrical connector having a shield that avoids the shortcomings of conventional shields.

SUMMARY

In accordance with one aspect, an electrical connector includes a dielectric housing, a plurality of electrical signal contacts carried by the dielectric housing, and a ground plate carried by the dielectric housing. The electrical signal contacts are arranged along a first plane, wherein the signal contacts define signal pairs such that a respective gap is disposed between adjacent signal pairs. The ground plate includes a ground plate body oriented in a second plane that is substantially parallel to the first plane and offset from the first plane. The ground plate body defines first and second opposed surfaces. The ground plate includes at least one stamped or embossed rib that defines first and second opposed surfaces, wherein the first surface of the rib projects from the first surface of the ground plate body in a direction toward the gap, and the second surface is recessed into the second surface of the ground plate body. The at least one stamped or embossed rib takes the place of or electrically functions as a ground contact between two differential signal pairs positioned edge-to-edge with respect to one another or broadside-to-broadside with respect to one another.

BRIEF DESCRIPTION OF THE DRAWINGS

The foregoing summary, as well as the following detailed description of a preferred embodiment of the application, will be better understood when read in conjunction with the appended drawings. For the purposes of illustrating the flexible anchoring keel and related instruments of the present application, there is shown in the drawings a preferred embodiment. It should be understood, however, that the application is not limited to the precise arrangements and instrumentalities shown. In the drawings.

DETAILED DESCRIPTION

Figure 1:
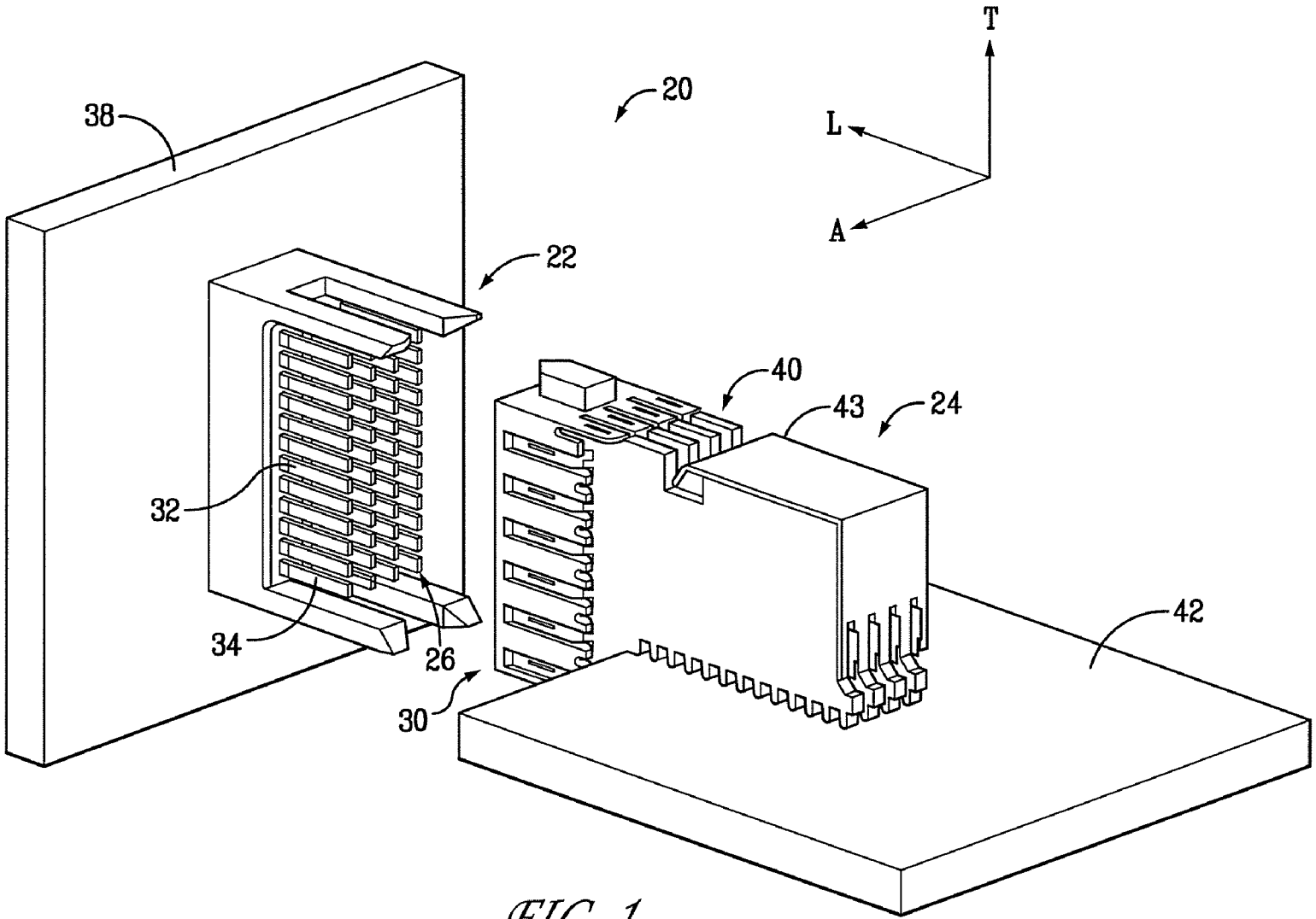
FIG. 1 is a perspective view of an electrical connector assembly including a vertical header connector and a right-angle receptacle connector mounted onto respective substrates, and configured to be mated with each other.
Figure 2A:
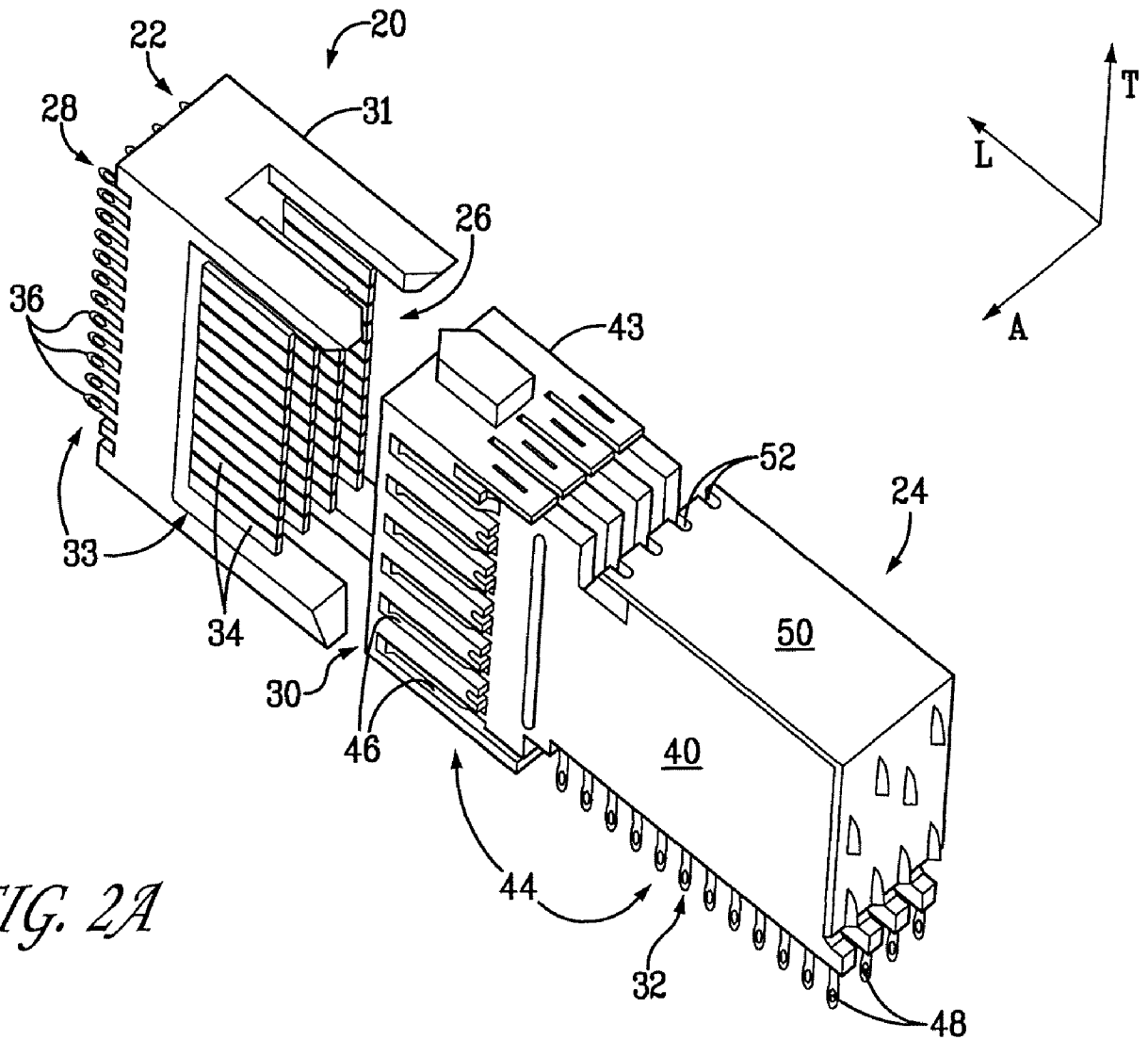
FIG. 2A is a perspective view of the electrical connector assembly similar to FIG. 1, but without the substrates.
Figure 2B:
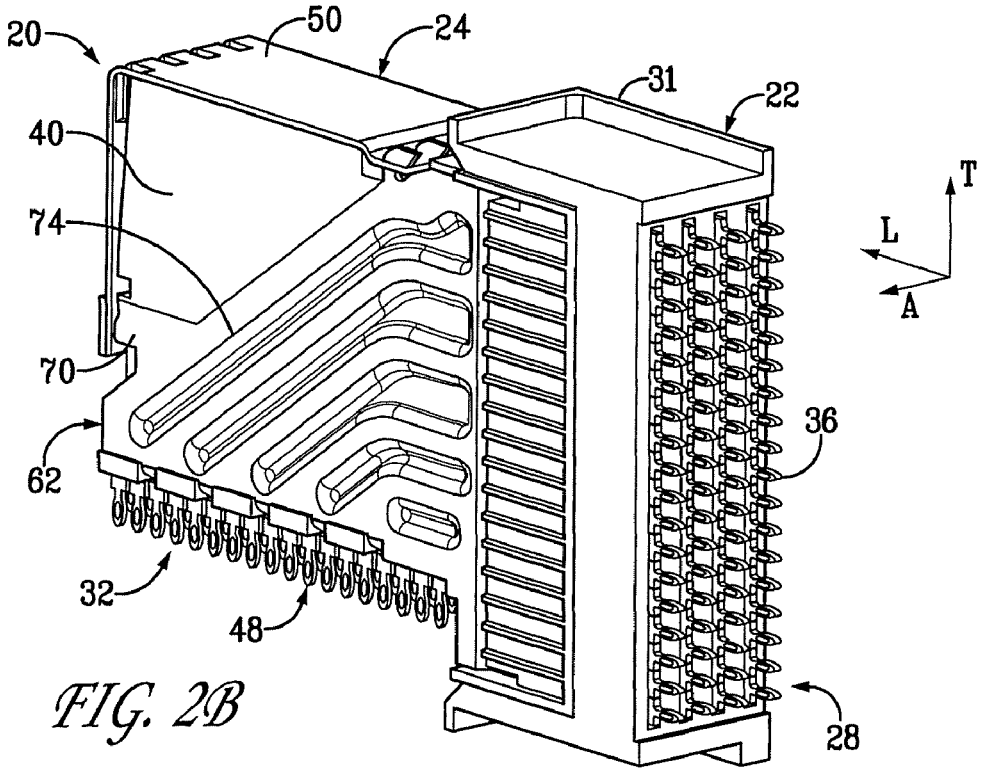
FIG. 2B is another perspective view of the electrical connector assembly as illustrated in FIG. 2A, but showing the electrical connectors in a mated configuration.

Referring initially to FIGS. 1-2B, an electrical connector assembly 20 includes a first electrical connector 22 and a second electrical connector 24 configured to mate with each other so as to establish an electrical connection between complementary substrates 38 and 42. As shown, the first electrical connector 22 can be a vertical connector defining a mating interface 26 and a mounting interface 28 that extends substantially parallel to the mating interface 26. The second electrical connector 24 can be a right-angle connector defining a mating interface 30 and a mounting interface 32 that extends substantially perpendicular to the mating interface 30.

The first electrical connector 22 includes a housing 31 that carries a plurality of electrical contacts 33. The electrical contacts 33 may be insert molded prior to attachment to the housing 31 or stitched into the housing 31. The electrical contacts 33 define respective mating ends 34 that extend along the mating interface 26, and mounting ends 36 that extend along the mounting interface 28. Each of the mating ends 34 can define a respective first broadside and a respective second broadside opposite the first broadside so as to define header mating ends. Thus, the first electrical connector 22 can be referred to as a header connector as illustrated. The mounting ends 36 may be press-fit tails, surface mount tails, or fusible elements such as solder balls, which are configured to electrically connect to a complementary electrical component such as a substrate 38 which is illustrated as a printed circuit board. The substrate 38 can be provided as a backplane, midplane, daughtercard, or the like.

Because the mating interface 26 is substantially parallel to the mounting interface 28, the first electrical connector 22 can be provided as a vertical connector, though it should be appreciated that the first electrical connector can be provided in any desired configuration so as to electrically connect the substrate 38 to the second electrical connector 24. For instance, the first electrical connector 22 can be provided as a header connector or a receptacle connector, and can be arranged as a vertical or mezzanine connector or a right-angle connector as desired.

With continuing reference to FIGS. 1-2B, the second electrical connector 24 includes a plurality of insert molded leadframe assemblies (IMLAs) 40 that are carried by an electrical connector housing 43. Each IMLA 40 carries a plurality of electrical contacts, such as right angle electrical contacts 44. Any suitable dielectric material, such as air or plastic, may be used to isolate the right angle electrical contacts 44 from one another. The right angle electrical contacts 44 define a respective receptacle mating ends 46 that extend along the mating interface 30, and a mounting ends 48 that extend along the mounting interface 32. Each mating end 46 extends horizontally forward along a longitudinal or first direction L, and the IMLAs 40 are arranged adjacent each other along a lateral or second direction A that is substantially perpendicular to the longitudinal direction L.

Each mounting end 48 extends vertically down along a transverse or third direction T that is perpendicular to both the lateral direction A and the longitudinal direction L. Thus, as illustrated, the longitudinal direction L and the lateral direction A extend horizontally as illustrated, and the transverse direction T extends vertically, though it should be appreciated that these directions may change depending, for instance, on the orientation of the electrical connector 24 during use. Unless otherwise specified herein, the terms "lateral," "longitudinal," and "transverse" as used to describe the orthogonal directional components of various components and do not limit to specific differential signal pair configurations. The terms "inboard" and "inner," and "outboard" and "outer" with respect to a specified directional component are used herein with respect to a given apparatus to refer to directions along the directional component toward and away from the center apparatus, respectively.

The receptacle mounting ends 48 may be constructed similar to the header mounting ends 36, and thus may include press-fit tails, surface mount tails, or fusible elements such as solder balls, which are configured to electrically connect to a complementary electrical component such as a substrate 42 which is illustrated as a printed circuit board. The substrate 42 can be provided as a backplane, midplane, daughtercard, or the like. The receptacle mating ends 46 are configured to electrically connect to the respective header mating ends 34 of the first electrical connector 22 when the respective mating interfaces 26 and 30 are engaged.

The right angle electrical contacts 44 may have a material thickness of about 0.1 mm to 0.5 mm and a contact height of about 0.1 mm to 0.9 mm. The contact height may vary over the length of the right angle electrical contacts 44. The second electrical connector 24 also may include an IMLA organizer 50 that may be electrically insulated or electrically conductive. An electrically conductive IMLA organizer 50 that retains the IMLAs 40 may be electrically connected to electrically conductive portions of the IMLAs 40 via slits 52 defined in the IMLA organizer 50 or any other suitable connection.

Because the mating interface 30 is substantially perpendicular to the mounting interface 32, the second electrical connector 24 can be provided as a right-angle connector, though it should be appreciated that the first electrical connector can be provided in any desired configuration so as to electrically connect the substrate 42 to the first electrical connector 22. For instance, the second electrical connector 24 can be provided as a receptacle connector or a header connector, and can be arranged as a vertical or mezzanine connector or a right-angle connector as desired. When the connectors 22 and 24 are mounted onto their respective substrates 38 and 42 and electrically connected to each other, the substrates are placed in electrical communication.

Figure 3A:
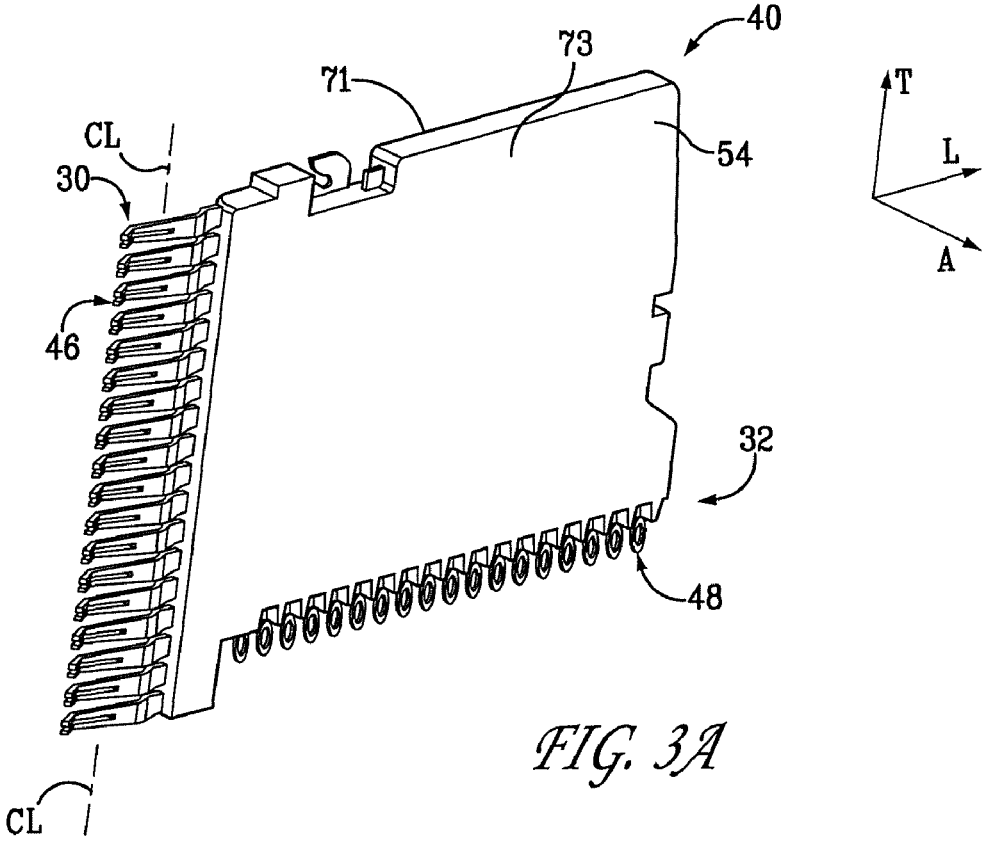
FIG. 3A is a perspective view of one of the IMLAs illustrated in FIGS. 2A-B.
Figure 3B:
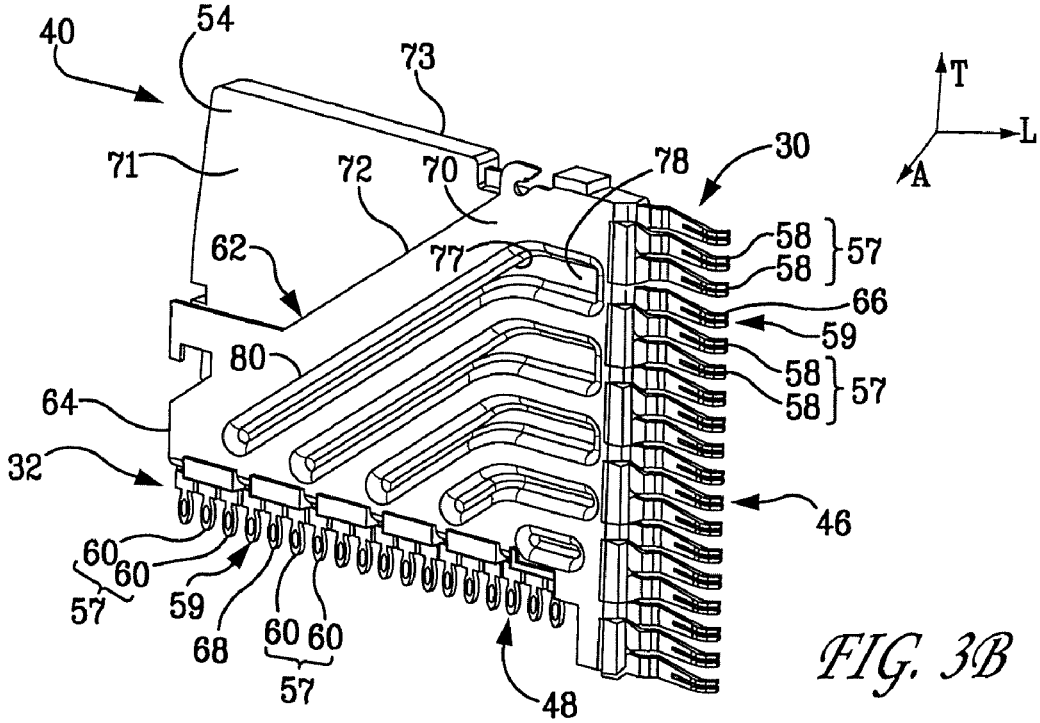
FIG. 3B is another perspective view of the IMLA illustrated in FIG. 3A showing the ground plate.
Figure 3C:
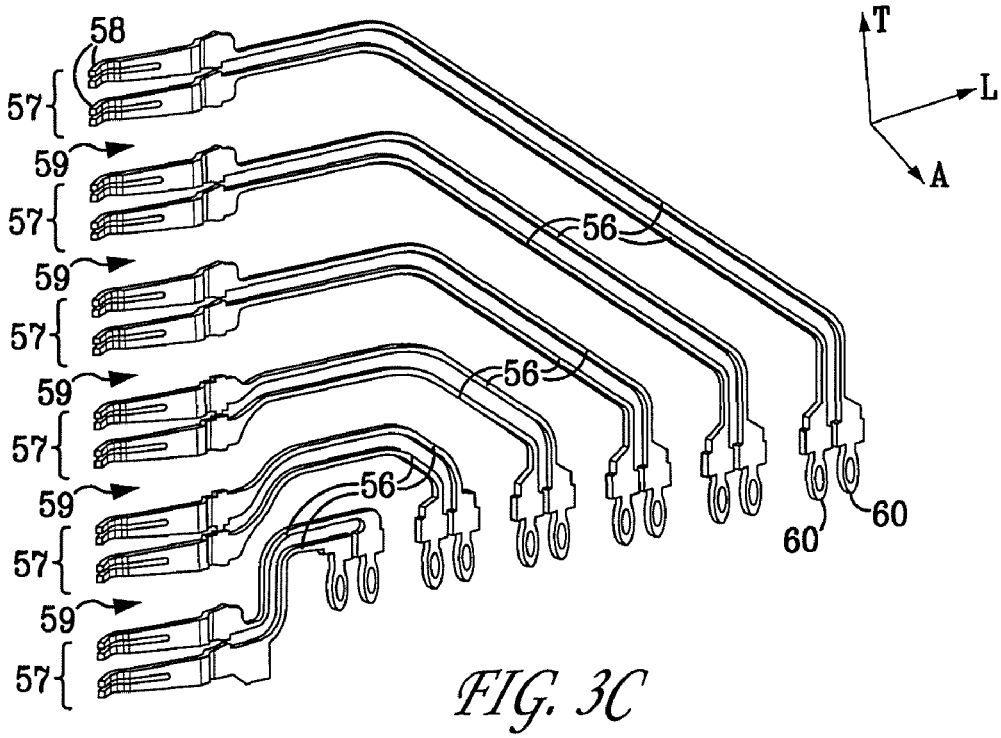
FIG. 3C is a perspective view of the electrical signal contacts of the IMLA illustrated in FIG. 3A, showing the electrical signal contacts arranged as supported by the leadframe housing.

Referring now also to FIGS. 3A-C, Each IMLA 40 includes a leadframe housing 54 which can be provided as a dielectric housing that defines laterally opposed outer surfaces 71 and 73. The leadframe housing can be made of any suitable dielectric material such as plastic, and carries a plurality of electrical signal contacts 56 form right-angle contacts which can be overmolded by the housing 54, or can alternatively can be stitched or otherwise attached in the housing 54. Each signal contact 56 includes a mating end 58 and a mounting end 60. The mating ends 58 of the signal contacts 56 are aligned along the transverse direction T, and the mounting ends 60 of the signal contacts 56 are aligned along the longitudinal direction L. The signal contacts 56 are arranged in pairs 57 (see also FIGS. 6B-C), which can be differential signal pairs. Alternatively, the signal contacts 56 can be provided as single-ended signal contacts. One or more up to all of adjacent pairs 57 of signal contacts 56 are separated by a gap 59.

Figure 4A:
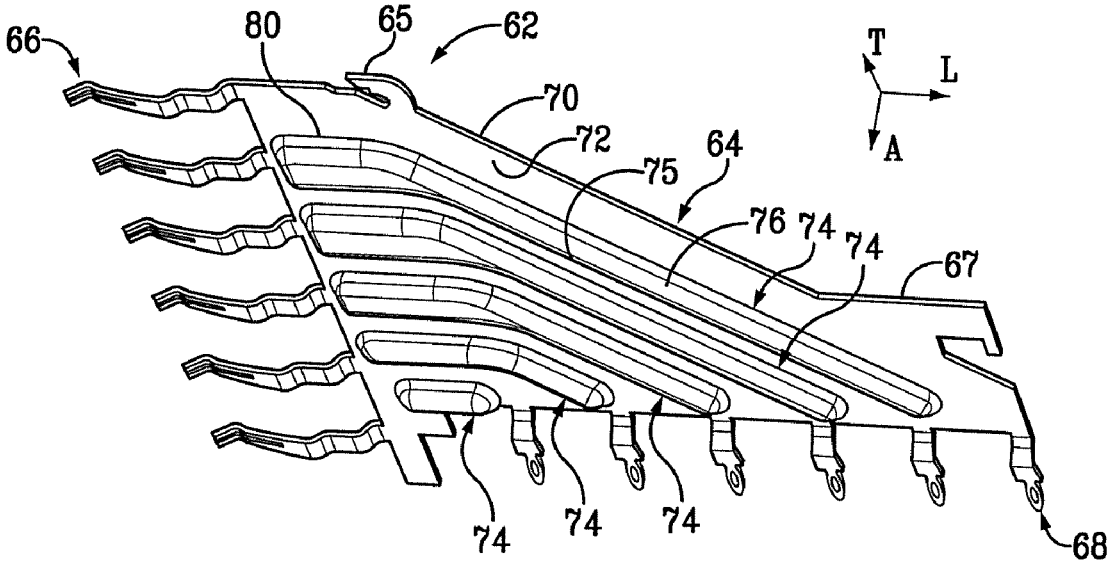
FIG. 4A is a perspective view of the ground plate illustrated in FIG. 3B.
Figure 4B:
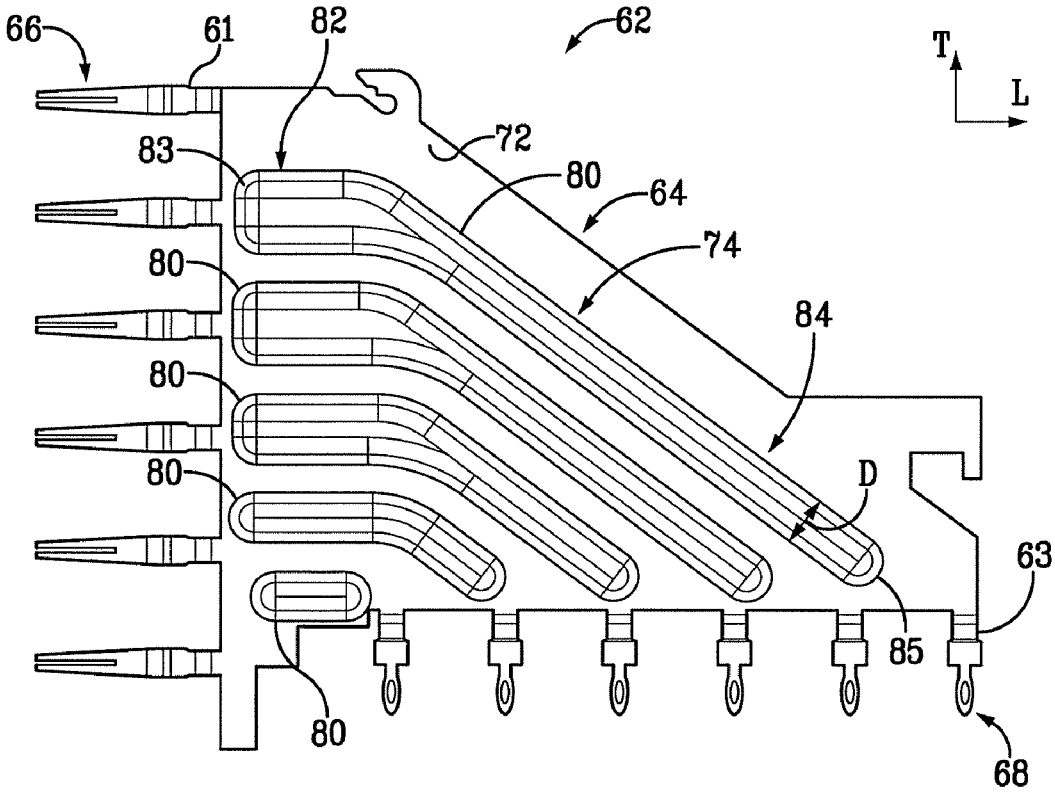
FIG. 4B is a side elevation view of the ground plate illustrated in FIG. 4A.
Figure 5A:
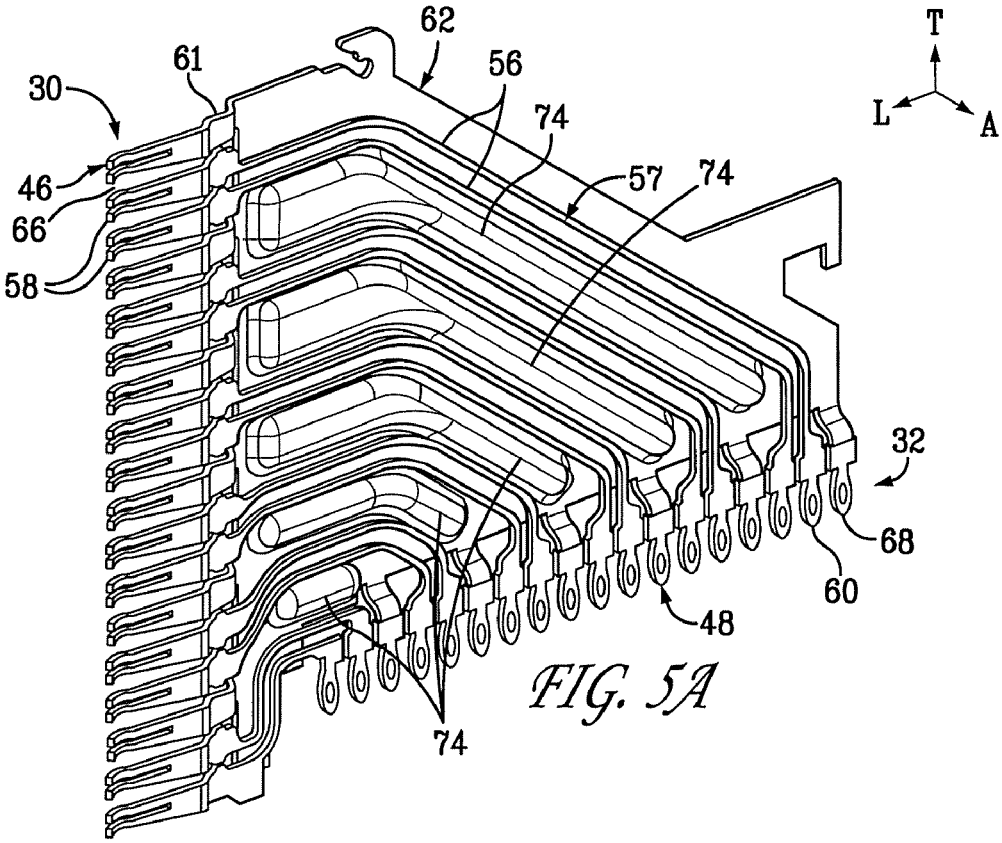
FIG. 5A is a perspective view of the IMLA as illustrated in FIG. 3A but with the leadframe housing removed.
Figure 5B:
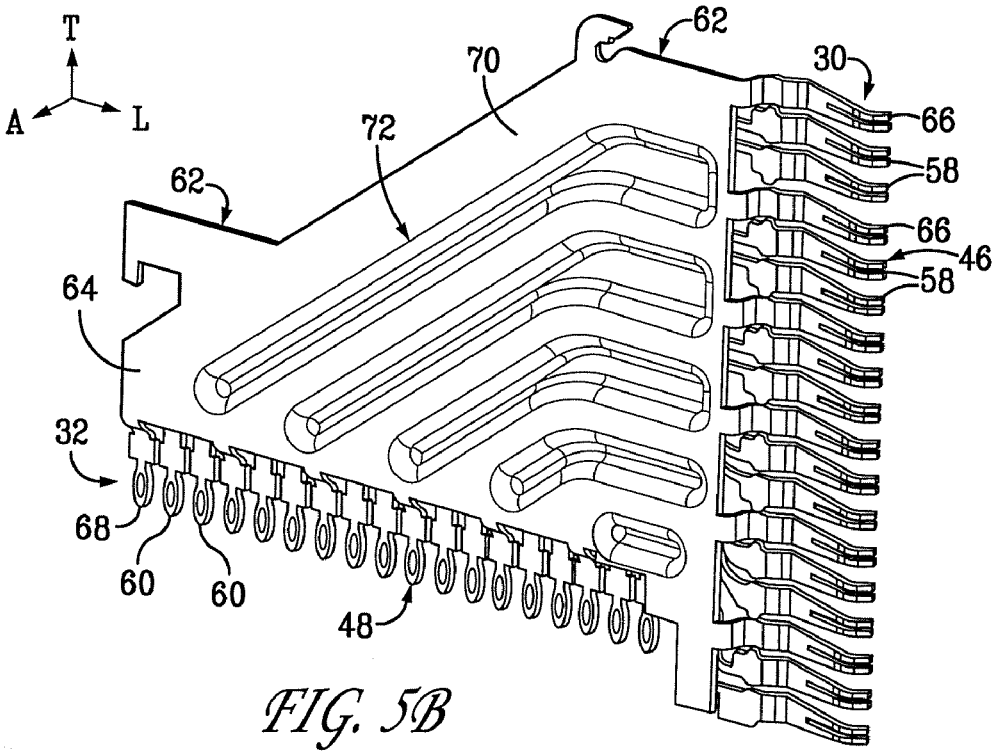
FIG. 5B is a perspective view of the IMLA as illustrated in FIG. 3B but with the leadframe housing removed.

Each IMLA 40 further includes a ground plate 62 that is carried by the leadframe housing 54. The ground plate 62 can be formed from any suitable electrically conductive material, such as a metal, and includes a body 64, a plurality of mating ends 66 extending forward from the body 64, and a plurality of mounting ends 68 extending down from the body. The mating ends 66 and mounting ends 68 can be constructed as described above with respect to the mating ends 58 and 60 of the electrical signal contacts 56. The ground plate 62 can be discretely attached to the housing 54 or overmolded by the housing 54. Referring now also to FIGS. 4A-B, the body 64 of the ground plate 62 defines an inner or first surface 72 and an outer or second surface 70 that is laterally opposed with respect to the inner surface 72. The outer surface 70 can be flush with, can protrude past, or can be inwardly recessed with respect to the corresponding outer surface 71 of the leadframe housing 54. Accordingly, the dimensions of the electrical connector 24 can remain unchanged with respect to electrical connectors whose IMLAs carry discrete ground contacts, for instance as described in U.S. Pat. No. 7,497,736, the disclosure of which is hereby incorporated by reference as if set forth in its entirety herein. The inner surface 72 faces the electrical signal contacts 56 of the IMLA 40. The ground plate 62 can further include at least one engagement member configured to attach to the organizer, such as upper or first hook 65 and a rear or second hook 67.

The ground plate 62 can be electrically conductive, and thus configured to reflect electromagnetic energy produced by the signal contacts 56 during use, though it should be appreciated that the ground plate 62 could alternatively be configured to absorb electromagnetic energy. For instance the ground plate 62 can be made from one or more ECCOSORB® absorber products, commercially available from Emerson & Cuming, located in Randolph, Mass. The ground plate 62 can alternatively be made from one or more SRC Polylron® absorber products, commercially available from SRC Cables, Inc, located in Santa Rosa, Ca. Furthermore, the ground plates 62 are disposed between the signal contacts 56 of adjacent IMLAs, the ground plates 62 can provide a shield that reduces cross-talk between signal the signal contacts 56 of adjacent IMLAs 40.

The mating ends 66 of the ground plate 62 define ground mating ends, while the mounting ends 68 of the ground plate 62 define ground mounting ends. The mating ends 66 are aligned along the transverse direction T, and are further aligned with the mating ends 58 along the transverse direction T. The mounting ends 68 are aligned along the longitudinal direction L, and are aligned with the mounting ends 60 along the longitudinal direction L. The mating ends 66 are positioned adjacent and/or between pairs 57 of mating ends 58, and the mounting ends 68 are positioned adjacent and/or between pairs of mounting ends 60. Thus, the mating ends 46 of the electrical connector 24 include both the mating ends 58 and the mating ends 66, and the mounting ends 48 of the electrical connector 24 include both the mounting ends 60 and the mounting ends 68.

In accordance with the illustrated embodiment, the mating ends 66 of the ground plate 62 are disposed in the gap 59 that extends between adjacent pairs 57 of mating ends 58, such that the mating ends 46, which includes mating ends 58 and 66, are equidistantly spaced along the mating interface 30 of the electrical connector 24. Likewise, the mounting ends 68 of the ground plate 62 are disposed in the gap 59 that extends between adjacent pairs of mounting ends 60, such that the mounting ends 48, which includes the mounting ends 60 and 68, are equidistantly spaced along the mounting interface 32 of the electrical connector 24.

The pairs 57 of electrical signal contacts 56 may be differential signal pairs, or the signal contacts 56 can be provided as single-ended contacts. The signal contacts 56 are positioned edge-to-edge along a common centerline CL. Six differential signal pairs 57 are illustrated, however the connector 24 can include any number of differential signal pairs extending along the centerline CL, such as two, three, four, five, six, or more.

Referring now to FIGS. 4A-5B, the ground plate 62 includes at least one rib 74, such as a plurality of ribs 74 supported by the plate body 64. In accordance with the illustrated embodiment, each rib 74 is stamped or embossed into the body 64, and is thus integral with the body 64. Thus, the ribs 74 can further be referred to as embossments. As illustrated, each rib 74 defines a first surface 75 that defines a projection 76 extending laterally inwardly (e.g., into the IMLA 40) from the inner surface 72, and an opposed second surface 77 that defines a corresponding divot 78 or recessed surface extending into the outer surface 70 of the ground plate body 64. Otherwise stated, the body 64 includes a plurality of projections 76 projecting laterally from the inner surface, and further includes a plurality of divots 78, corresponding to the plurality of projections 76, recessed in the outer surface 70. The ribs 74 define respective enclosed outer perimeters 80 that are spaced from each other along the ground plate body 64. Thus, the ribs 74 are fully contained in the plate body 64.

The ribs 74 define a front or first portion 82 disposed proximate to the mating ends 66, and a rear or second portion 84 that is disposed proximate to the mounting ends 68. The front and rear portions 82 and 84 define a respective front or first terminal end 83, and a rear or second terminal end 85. The ribs 74 thus define a length extending between the first end second terminal ends 83 and 85. As illustrated, the ribs 74 can have different lengths along the ground plate body 64. For instance, those ribs 74 disposed at an upper or first end of the ground plate body 64 are longer than the ribs 74 that are disposed at a lower or second end of the ground plate body 64. In accordance with the illustrated embodiment, the length of each ribs 74 decreases along a direction from the upper or first end to the lower or second end of the ground plate body 64.

The ribs 74 can extend along a direction that includes one or more of a horizontal or lateral direction, a vertical or transverse direction, and an angled direction having both lateral and transverse directional components. For instance, as illustrated, the front portions 82 of some of the ribs 74 extend along a lateral rearward or direction from a location proximate to the mating ends 66 to the rear portion 84. The rear portion 84 extends along a second direction that is laterally rearward and transversely down from the front portion 82 to a location proximate to the mounting ends 68. The rear portion 84 extends at an angle between 90° and 180° with respect to the front portion 82. It should be appreciated that one or more of the ribs 74, for instance the bottommost rib 74 shown in FIG. 4B, extends only longitudinally. It should be further appreciated that one or more of the ribs 74 can further extend along a third transverse direction, for instance at a location proximate to the mounting ends 68.

Referring now to FIGS. 4A-6C, the electrical signal contacts 56 are aligned or arranged in a first transverse-longitudinal plane T-L1 that includes the common centerline CL, and the ground plate body 64 is oriented in a second transverse-longitudinal ground plane T-L2 that extends substantially parallel to the first plane T-L1, and is laterally outwardly offset or spaced from the first plane T-L1. The projection 76 of each rib 74 extends laterally inward from the inner surface 72 of the ground plate body 64 toward the first plane T-L1. The projections 76 can extend laterally from the inner surface 72 a distance sufficient such that a portion of each projections 76 extends into the first plane T-L1 and is thus co-planar with the signal contacts 56 (or a portion of the signal contacts 56), but less than the thickness of the leadframe housing 54 such that the projections 76 are recessed with respect to the outer surface 73 (see FIG. 3B). The projections 76 are aligned with the gaps 59 disposed between adjacent pairs 57 of signal contacts 56, such that the portion of each projection 76 that extends into the first plane T-L1 between adjacent pairs 57 is disposed in a corresponding one of the gaps 59.

The ground plate 62 includes a first neck 61 extending between the ground plate body 64 and each mating end 66, and a second neck 63 extending between the ground plate body 64 and each mounting end 68. In particular, each first neck 61 extends laterally inward from the second plane T-L2 toward the first plane T-L1 along a longitudinally forward direction from the ground plate body 64, such that the mating ends 66 lie in the first plane T-L1 and are thus co-planar with the mating ends 58 of the signal contacts 56. Likewise, the second neck 63 extends laterally inward from the second plane T-L2 toward the first plane T-L1 along a transversely downward direction from the ground plate body 64, such that the mounting end 68 lies in the first plane T-L1, and is thus co-planar with the mounting ends 60 of the signal contacts 56.

Each rib 74 defines a cross-sectional distance D that extends along the second plane T-L2 in a direction normal to the outer perimeter 80. The distance D can be consistent along the length of a given rib 74, as illustrated in the lowermost rib 74 shown in FIG. 4A. Alternatively, the distance D can vary along the length of a given rib between the front and rear ends 83 and 85, respectively. For instance, the distance D can be smaller at the rear portion 84 than at the front portion 82. Otherwise stated, the distance D can increase along the length of the rib 74 from the rear portion 84 to the front portion 82. Likewise, the gap 59 disposed between adjacent pairs 57 of signal contacts 56 can increase along a direction from the mounting ends 60 toward the mating ends 58 so as to accommodate the increasing cross-sectional distance D of the ribs 74.

Figure 6A:
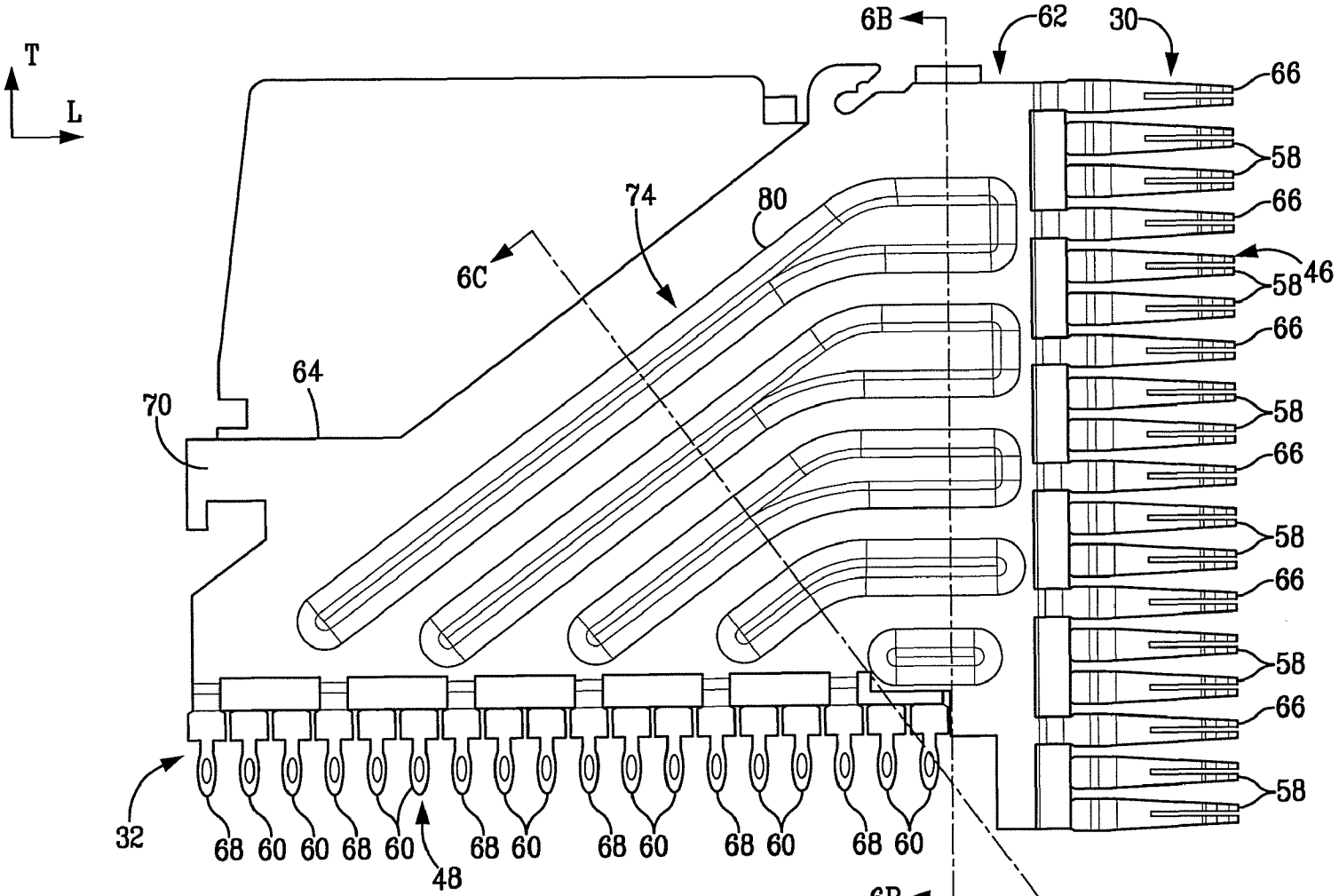
FIG. 6A is a side elevation view of the IMLA illustrated in FIG. 3B.
Figure 6B:
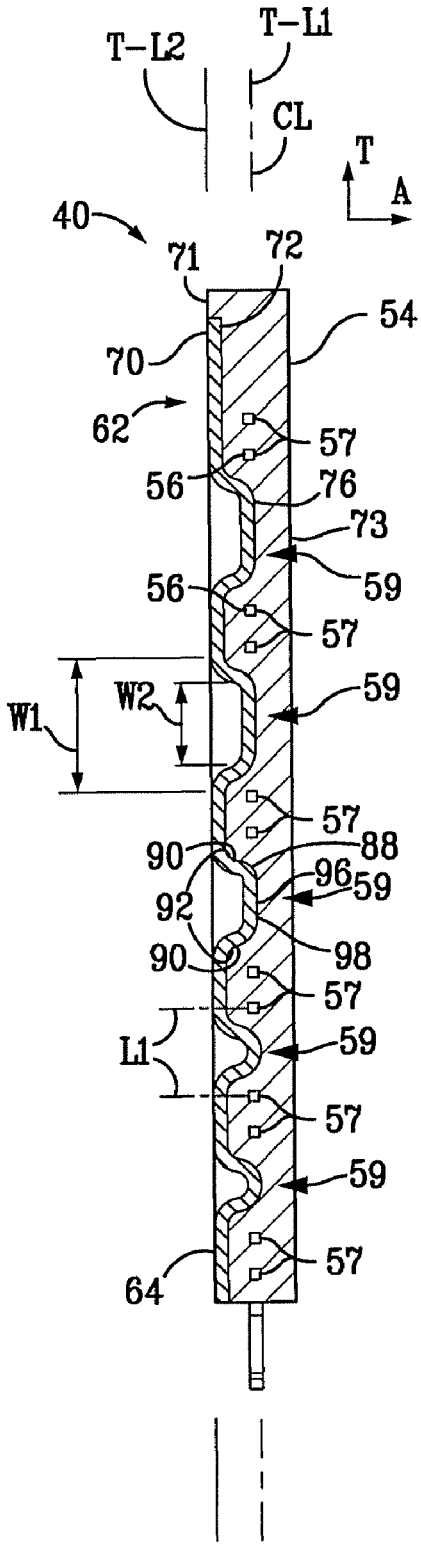
FIG. 6B is a sectional view of the IMLA illustrated in FIG. 6A, taken along line 6B-6B.
Figure 6C:
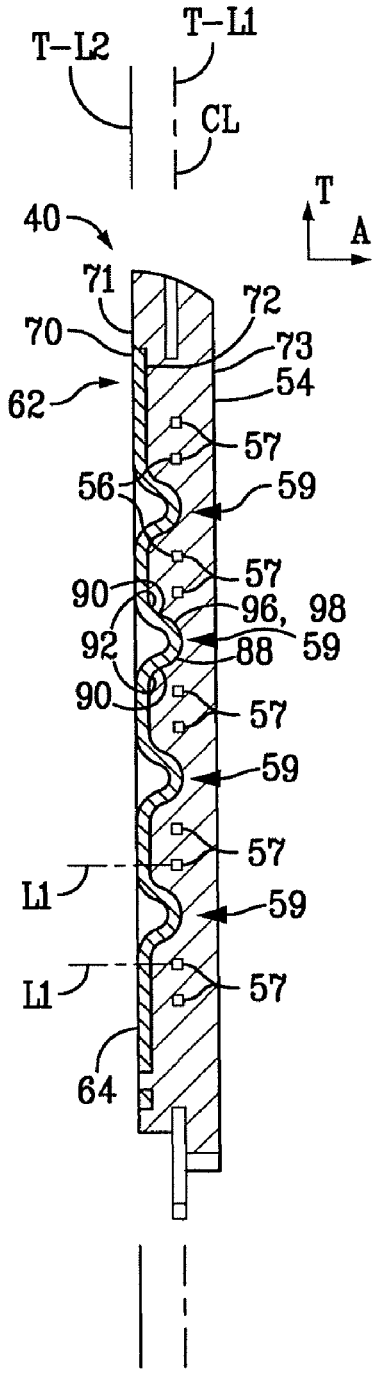
FIG. 6C is a sectional view of the IMLA illustrated in FIG. 6A, taken along line 6C-6C.

With continuing reference to FIGS. 4A-6C, and in particular to FIGS. 6B-C, each rib 74 can include at least one wall 88. The wall 88 includes opposed outer wall portions 90 that each extend laterally from the inner surface 72 at the outer perimeter 80, and can converge toward each other along their direction of extension from the inner surface 72. When the ground plate 62 is installed in the IMLA, the outer wall portions 90 extend into a corresponding one of the gaps 59 between adjacent pairs 57 of signal contacts 56. As illustrated, the outer wall portions 90 can be beveled or curved. Furthermore, the curvature of each rib 74 can vary along its length. The outer wall portions 90 define from a proximal end 92 of the rib 74, and terminate at a middle wall portion 96 that is connected between the outer wall portions 90. The proximal end 92 of the rib 74 is the portion of the rib 74 that extends from the inner surface 72 at a location proximate to the inner surface 72.

The middle wall portion 96 is thus disposed at a location that is laterally offset with respect to the inner surface 72 of the ground plate body 64. In accordance with the illustrated embodiment, the middle wall portion 96 defines a distal end 98 of the rib 74 that lies in the first plane T-L1. The middle wall portion 96 can include a curved portion along a direction extending normal to the signal contacts 56 that define the corresponding gap 59, or can alternatively or additionally include a flat portion along a direction extending normal to the signal contacts 56 that define the gap 59. In this regard, it should be appreciated that the middle wall portion 96 can alternatively be entirely curved along a direction extending normal to the signal contacts 56 that define the corresponding gap 59, or entirely flat along a direction extending normal to the signal contacts 56 that define the gap 59. Thus, the ribs 74 can define curvatures that vary from each other. It should thus be appreciated that the ribs 74 can be curved or tapered, and thus devoid of sharp edges that are out of plane T-L1 with respect to the differential signal contacts 56. Furthermore, each rib 74 can be spaced at a consistent distance along its length from its adjacent signal contacts 56 that define the corresponding gap 59. Moreover, each rib 74 can be spaced from its adjacent signal contacts 56 a distance that is substantially equal to the distance that one or more up to all of the other ribs 74 are spaced from their adjacent signal contacts.

While the middle wall portion 96 can lie in the first plane T-L1 as illustrated, it should be appreciated that the rib 74 could alternatively terminate at the distal end 98 which is positioned inward of, or past, the first plane T-L1. In accordance with the illustrated embodiment, the middle wall portion 96 extends at substantially a constant lateral distance LD from the inner surface 72 of the ground plate 62 that is substantially equal to the lateral distance between the second plane T-L2 and the first plane T-L1.

It should be appreciated that a portion of each rib 74 can overlap the electrical signal contacts 56 that define the corresponding gap 59 with respect to an axis extending through the signal contacts 56 in a direction perpendicular to and between the first and second planes T-L1 and T-L2. Alternatively, the ribs 74 can be wholly contained between the axes extending through the signal contacts 56 in a direction perpendicular to and between the first and second planes T-L1 and T-L2. For instance, In accordance with the illustrated embodiment, the proximal end 92 of each rib 74 is positioned inward with respect to the corresponding signal contacts 56 that define the gap 59. Accordingly, a lateral axis L1 that extends through the proximal ends 92 one or more ribs 74 also extends through the corresponding gap 59, and not one of the signal contacts 56 that defines the gap 59. Alternatively, the proximal ends 92 could be disposed outward or inline with respect to the corresponding signal contacts 56 that define the gap 59. Accordingly, the lateral axis L1 that extends through the proximal ends 92 or other locations of the rib 74 can also extend through one or both signal contacts 56 that defines the corresponding gap 59.

With continuing reference to FIGS. 4A-6C, each rib 74 can define a first width W1 extending along a direction parallel to the ground plate plane T-L2 at the proximal end 92, and a second width W2 extending along the direction parallel to the ground plate plane T-L2 at the distal end 98 that is less than the first width W1 in accordance with the illustrated embodiment. The widths W1 and W2 of at least one rib 74 can be less than, greater than, or substantially equal to one or both of the corresponding widths W1 and W2 of one or more of the other ribs 74.

Figure 8:
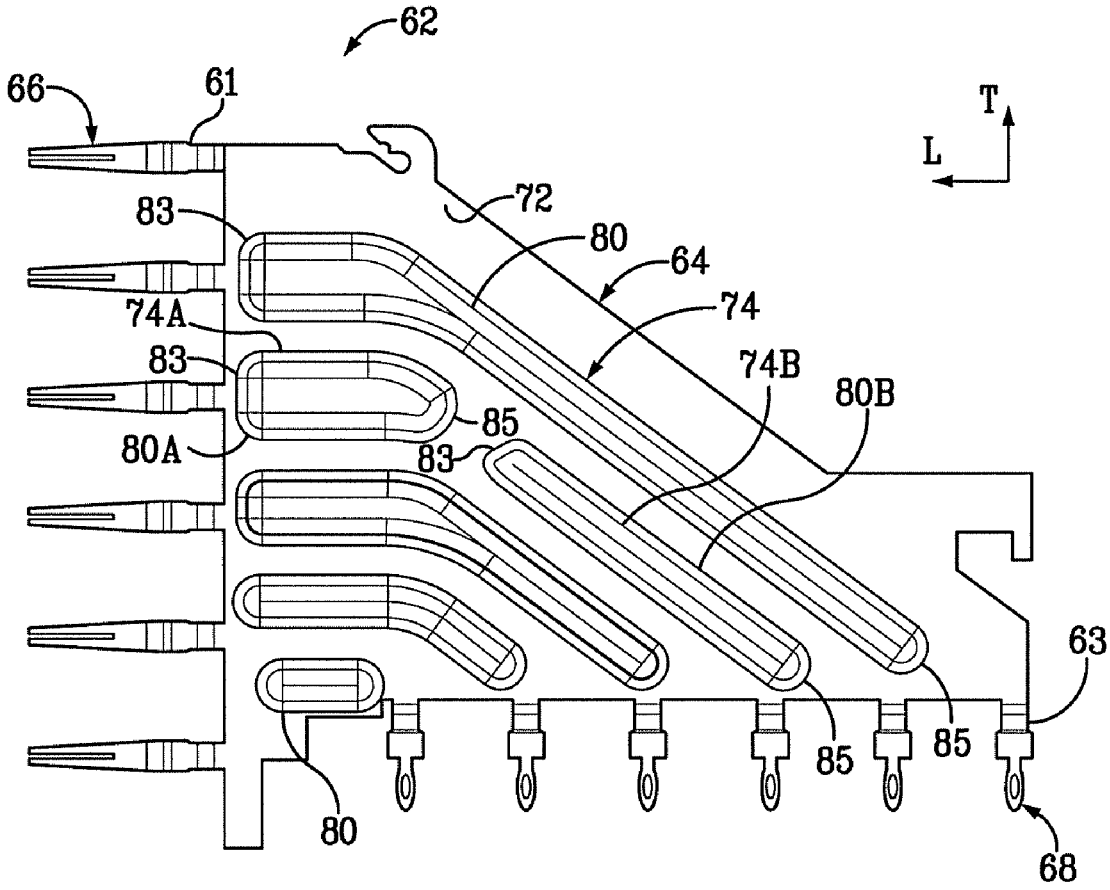
FIG. 8 is a side elevation view of a ground plate similar to the ground plate illustrated in FIG. 4B, but constructed in accordance with an alternative embodiment.

While the ribs 74 are illustrated as extending continuously from their respective front end 83 to their rear ends 85, it should be appreciated that one or more up to all of the ribs 74 can be discontinuous or segmented between the front and rear ends 83 and 85. For instance, as illustrated in FIG. 8, one or more the ribs 74 can be provided as separate rib segments 74*a* and 74*b*, each defining respective enclosed perimeters 80*a* and 80*b* spaced from each other between the corresponding mating end 66 and mounting end 68. Alternatively or additionally, the middle wall portion 96 of a given rib 74 can project a distance from the inner surface 72 that varies along the length of the rib 74 between the front end 83 and the rear end 85.

While FIGS. 6B-C show the leadframe housing 54 overmolded onto the signal contacts 56 and the ground plate 62, it should be appreciated that the signal contacts 56, the ground plate 62, or both the signal contacts 56 and the ground plate 62 can be discreetly attached to the leadframe housing 54. Furthermore, while the ground plate 62 is shown as abutting the leadframe housing 54 along its length, the ground plate 62 can alternatively be supported by the leadframe housing 54 at discrete locations of the ground plate 62, such that one or more air gaps are disposed between the housing 54 and the ground plate 62 and desired locations. For instance, an air gap between the leadframe housing 54 and the ribs 74 would allow for clearance of the ribs 74 when the ground plate 62 is attached to the leadframe housing 54. It should be further appreciated that such air gaps could further be provided when the leadframe housing 54 is overmolded onto the ground plate 62. Likewise, while the signal contacts 56 are shown as abutting the leadframe housing 54 along their length, the signal contacts 56 can alternatively be supported by the leadframe housing 54 at discrete locations of the signal contacts 56, such that air gaps are disposed between the housing 54 and the signal contacts and desired locations. It should be further appreciated that such air gaps could further be provided when the leadframe housing 54 is overmolded onto the signal contacts 56.

Figure 7A:
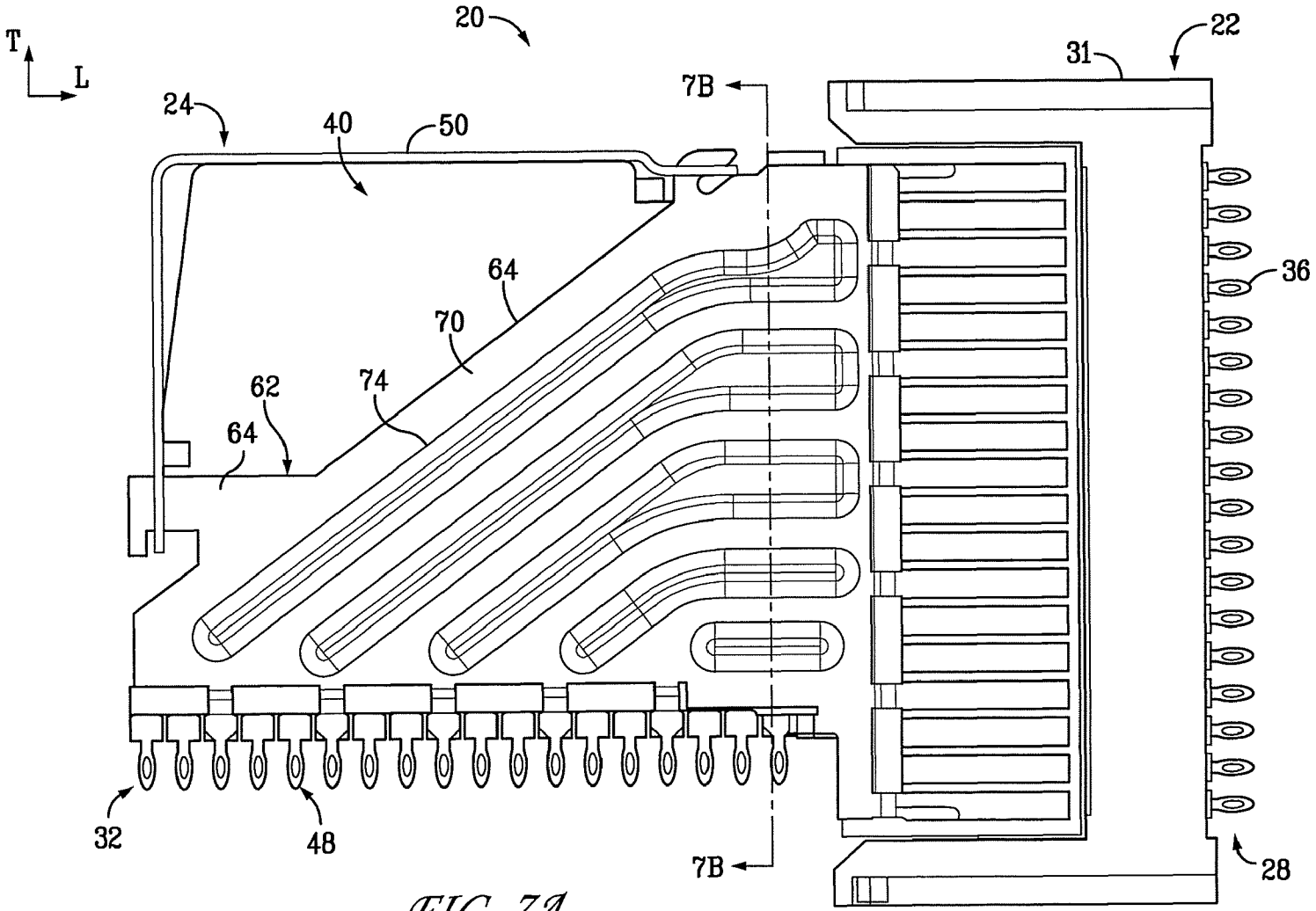
FIG. 7A is a side elevation view of the electrical connector assembly as illustrated in FIG. 2B.
Figure 7B:
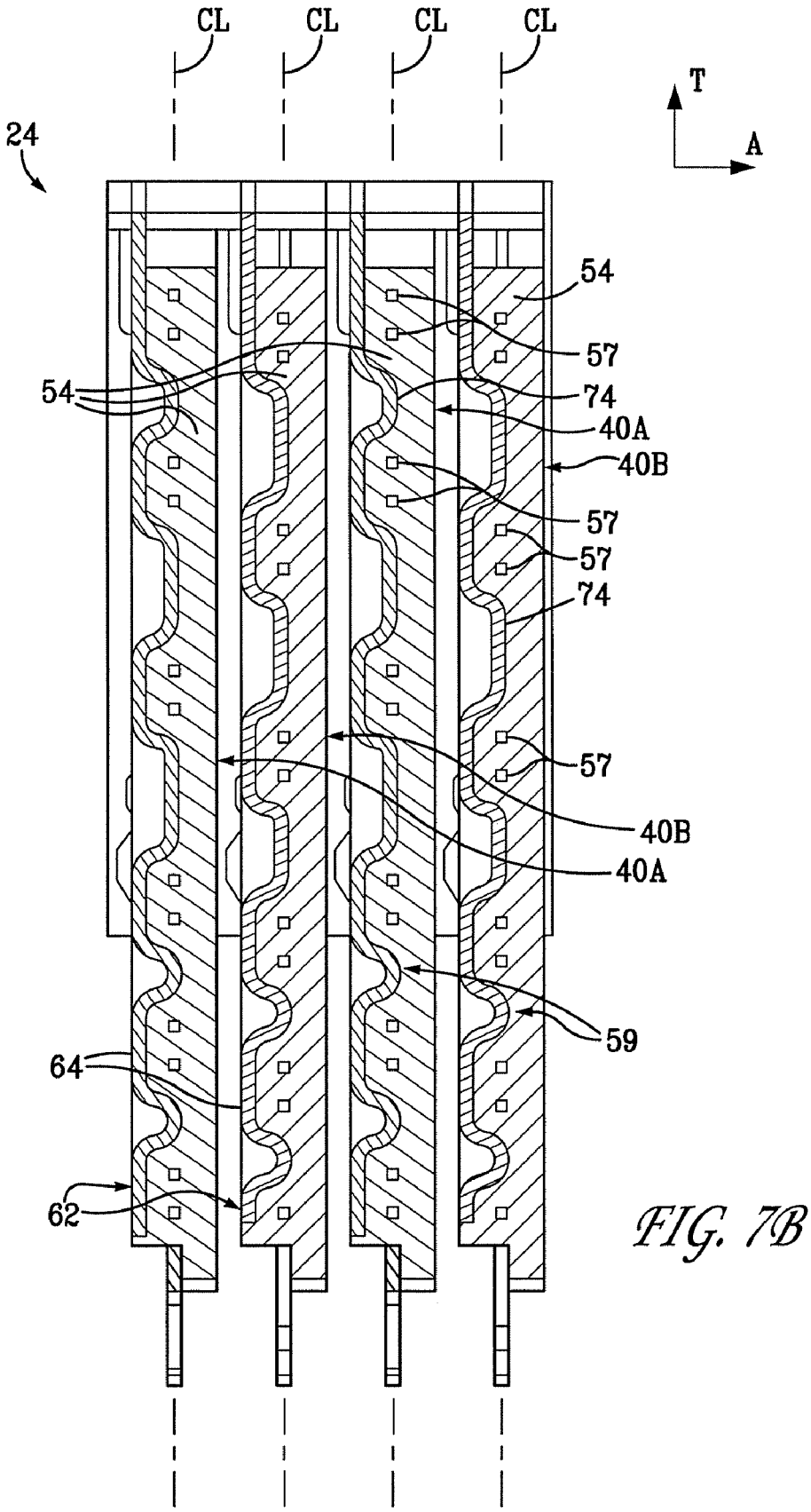
FIG. 7B is a sectional view of the electrical connector assembly illustrated in FIG. 7A, taken along line 7B-7B.

Referring now to FIGS. 7A-B, the electrical connector 24 is illustrated as including a plurality of IMLAs 40 of the type described above. Four IMLAs 40 are illustrated having electrical contacts 44 that extend along respective common centerlines CL, though it should be appreciated that the connector 24 can include as many IMLAs 40 as desired. Each IMLA can include as many electrical signal contact pairs 57 and interleaved ribs 74 as desired. Thus, one or more up to all of the IMLAs 40 can include a ground plate 62 of the type described above. The IMLAs 40 include a first-type of IMLAs 40A that are substantially identically constructed and a second type of IMLAs 40B that substantially identically constructed. The IMLAs 40A and 40B are alternately arranged along the lateral direction A. In accordance with the illustrated embodiment, the signal contacts 56 of the first IMLAs 40A are staggered with respect to the signal contacts 56 of the second IMLAs 40B. Accordingly, the gaps 59 between adjacent signal pairs 57 of the first IMLAs 40*a* are staggered with respect to the gaps 59 of the second IMLAs 40B. It should be appreciated that the mating ends 66 and mounting ends 68 can extend from any position along the ground plate body 64 as desired, such that the mating ends 66 are disposed between and aligned with the mating ends 58 of the signal contacts 56 in the manner described above, and the mounting ends 68 are disposed between and aligned with the mounting ends 60 of the signal contacts 56 in the manner described above.

For instance, in accordance with one embodiment, the mating ends 46 of the first IMLAs 40A are arranged in a repeating G-S-S-G-S-S pattern in a direction along the common centerline CL from the top of the mating interface 30 toward the bottom of the mating interface 30, whereby "G" denotes electrical ground contact mating ends 66 and "S" denotes electrical signal contact mating ends 58. Furthermore, in accordance with one embodiment, the mating ends 46 of the second IMLAs 40B are arranged in a repeating S-S-G-S-S-G pattern in a direction along the common centerline CL from the top end of the mating interface 30 toward the bottom of the mating interface 30, whereby "G" denotes electrical ground contact mating ends 66 and "S" denotes electrical signal contact mating ends 58.

It should thus be appreciated that a method of producing an electrical connector includes the steps of 1) providing a plurality of electrical signal contacts 56, 2) retaining the electrical signal contacts 56 in the leadframe housing 54 along the first plane T-L1 so as to define gaps 59 disposed between adjacent pairs of electrical signal contacts 56, 3) providing a ground plate 62 having a ground plate body 64 that defines first and second opposed surfaces 72 and 70, respectively, 4) stamping a plurality of ribs 74 into the second surface 70 of the ground plate body 64 such that the ribs 74 define first and second opposed surfaces 75 and 77, respectively, wherein the first surface 75 of each rib 74 projects out from the first surface 72 of the ground plate body 64, and the second surface 77 of each rib is recessed in the second surface 70 of the ground plate body 64, and 5) attaching the ground plate 62 to the leadframe housing 54 such that the ground plate body 64 is oriented in the second plane T-L2 that is offset with respect to the first plane T-L1, and the first surface 75 of each rib 74 projects toward a respective one of the gaps 59 defined by the adjacent pairs 57 of electrical signal contacts 56.

The ground plate 62 is a wide continuous conductor, and is wider than the ground contacts of an electrical connector that is substantially identical with respect to the electrical connector 24, with the exception that the substantially identical electrical connector does not include the ground plate 62, but instead includes discrete ground contacts extending in the gaps 59 that define opposing ground mating ends and ground mounting ends as described in U.S. Pat. No. 7,497,736. Accordingly, it should be appreciated that the electrical connector 24 can be modified with respect to substantially identical electrical connector, with the exception that the electrical connector 24 is devoid of discrete ground contacts in favor of the ground plate 62 having ribs 74 that extend between adjacent pairs 57 of signal contacts 56. Thus, the electrical connector 24 is an improvement over shieldless, high density, right-angle electrical connectors that have discrete ground contacts without significantly lowering impedance matching and without significantly increasing inductance. In accordance with embodiments of the present invention, the impedance of the electrical connector 24 is not significantly altered with respect to a pre-modified connector, inductance of the electrical connector 24 is lower than the ground contacts in the same pre-modified connector, crosstalk of the electrical connector 24 is lower as compared to the same pre-modified connector, and the overall dimensions of the electrical connector 24 are the same as those of the pre-modified connector For instance, it is believed that the ground plate 62 provides a low-impedance common path that intercepts and dissipates stray electro-magnetic energy between signal contacts 56 that otherwise would have been a source for cross talk. It is believed that a connector that incorporates the IMLAs 40 as described above can operate at 13 GHz with acceptable worst-case, multi-active crosstalk on a victim pair of no more than six percent, for instance less than one percent, such as 0.4 percent. Worst case, multi-active crosstalk may be determined in the manner described in U.S. Pat. No. 7,497,736.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. Those skilled in the relevant art, having the benefit of the teachings of this specification, may effect numerous modifications to the invention as described herein, and changes may be made without departing from the spirit and scope of the invention as defined by the appended claims.

What is claimed:

1. An electrical connector comprising:

a dielectric housing;

a plurality of electrical signal contacts carried by the dielectric housing and arranged along a first plane, wherein the signal contacts define signal pairs such that a respective gap is disposed between adjacent signal pairs, and the electrical signal contacts further define respective mating ends and mounting ends;

an electrically conductive ground plate carried by the dielectric housing, the ground plate including a ground plate body oriented in a second plane that is substantially parallel to the first plane and offset from the first plane, the ground plate body defining first and second opposed surfaces, the ground plate including at least one rib that defines first and second opposed surfaces, wherein the first surface of the rib projects from the first surface of the ground plate body in a direction toward the gap, and the second surface is recessed into the second surface of the ground plate body, and the ground plate includes respective mating ends and mounting ends extending from the ground plate body.

2. The electrical connector as recited in claim 1, wherein the dielectric housing is a leadframe housing overmolded onto the electrical signal contacts.

3. The electrical connector as recited in claim 2, wherein the ground plate is discretely attached to the leadframe housing.

4. The electrical connector as recited in claim 2, wherein the ground plate is overmolded by the leadframe housing.

5. The electrical connector as recited in claim 1 further comprising a plurality of electrical signal pairs defining respective gaps between adjacent electrical signal pairs, wherein the ground plate defines a plurality of ribs that defines opposed first and second surfaces, wherein the first surface of each rib projects from the first surface of the ground plate body in a direction toward a corresponding one of the gaps, and the second surface of each rib is recessed into the second surface of the ground plate body.

6. The electrical connector as recited in claim 5, wherein at least one of the ribs extends along a length that is different with respect to at least one of the other ribs.

7. The electrical connector as recited in claim 5, wherein the ribs each have a portion that is disposed in the first plane, and the portion that is disposed in the first plane of at least one of the ribs has a curvature that is different than the first plane of at least one of the other fibs.

8. The electrical connector as recited in claim 5, wherein at least one of the ribs is segmented.

9. The electrical connector as recited in claim 1, wherein the mating ends and mounting ends of the grounding plate are disposed in the first plane.

10. The electrical connector as recited in claim 1, wherein the electrical connector has the same overall dimension as a substantially identically constructed electrical connector that does not include the ground plate and instead includes a discrete electrical ground contact disposed in the gap.

11. The electrical connector as recited in claim 1, wherein the pairs of electrical signal contacts comprise differential pairs.

12. The electrical connector as recited in claim 1, wherein the electrical signal contacts are right-angle contacts.

13. An electrical connector comprising:

an organizer; and a plurality of insert molded leadframe assemblies (IMLAs) retained by the organizer, each insert molded leadframe assembly including;

a dielectric housing;

a plurality of electrical signal contacts carried by the dielectric housing and arranged along a first plane, wherein the signal contacts are arranged in pairs such that respective gaps are disposed between adjacent pairs of signal contacts, the signal contacts defining respective mating ends and mounting ends;

an electrically conductive ground plate carried by the dielectric housing, the ground plate including a ground plate body oriented in a second plane that is substantially parallel to the first plane and offset from the first plane, the ground plate body defining first and second opposed surfaces, the ground plate including:

a plurality of ribs that each defines first and second opposed surfaces, wherein the first surface of each rib projects from the first surface of the ground plate body in a direction toward a respective one of the gaps, and the second surface is recessed into the second surface of the ground plate body;

a plurality of mating ends extending from the ground plate body and offset from the ground plate body so as to extend in the respective gaps in the first plane aligned with the mating ends of the electrical signal contacts; and a plurality of mounting ends extending from the ground plate body and offset from the ground plate body so as to extend in the respective gaps in the first plane aligned with the mounting ends of the electrical signal contacts.

14. The electrical connector as recited in claim 13, wherein the plurality of IMLAs includes a first type of IMLA and a second type of IMLA alternately arranged, wherein the signal contacts of the first type of IMLA are staggered with respect to the signal contacts of the second type of IMLA.

15. A method of producing an electrical connector, comprising the steps of:

providing a plurality of electrical signal contacts that define respective mating ends and mounting ends;

retaining the electrical signal contacts in a dielectric housing along a first plane so as to define gaps disposed between adjacent pairs of electrical signal contacts;

providing an electrically conductive ground plate having a ground plate body that defines first and second opposed surfaces the ground plate including mating ends and mounting ends that extend from the ground plate body;

stamping a plurality of ribs into the second surface of the ground plate body such that the ribs define first and second opposed surfaces, wherein the first surface of each rib projects out from the first surface of the ground plate body, and the second surface of each rib is recessed in the second surface of the ground plate body;

attaching the ground plate to the dielectric housing such that the ground plate body is oriented in a second plane offset with respect to the first plane, and first surface of each rib projects toward a respective one of the gaps defined by the adjacent pairs of electrical signal contacts.

* * * * *

UNITED STATES PATENT AND TRADEMARK OFFICE

CERTIFICATE OF CORRECTION

PATENT NO. : 8,366,485 B2
APPLICATION NO. : 12/722797
DATED : February 5, 2013
INVENTOR(S) : Johnescu et al.

It is certified that error appears in the above-identified patent and that said Letters Patent is hereby corrected as shown below:

COL. 11, LINE 17, [CLAIM 7] after "other" delete "fibs" and substitute therefore --ribs--

Signed and Sealed this
Twenty-sixth Day of March, 2013

Teresa Stanek Rea
*Acting Director of the United States Patent and Trademark Office*